US006462261B1

(12) United States Patent
Smith

(10) Patent No.: US 6,462,261 B1
(45) Date of Patent: Oct. 8, 2002

(54) HARMONICAS

(76) Inventor: Richard Smith, The Sty St. Donats, Portway, Burghill Heresford HR4 8NQ (GB)

( * ) Notice: Subject to any disclaimer, the term of this patent is extended or adjusted under 35 U.S.C. 154(b) by 0 days.

(21) Appl. No.: 09/830,901

(22) PCT Filed: Nov. 2, 1999

(86) PCT No.: PCT/GB99/03611

§ 371 (c)(1),
(2), (4) Date: Jun. 19, 2001

(87) PCT Pub. No.: WO00/26894

PCT Pub. Date: May 11, 2000

(30) Foreign Application Priority Data

Nov. 3, 1998 (GB) ..... 9823915
Mar. 5, 1999 (GB) ..... 9905150

(51) Int. Cl.[7] ..... G10D 7/12
(52) U.S. Cl. ..... 84/377; 84/378
(58) Field of Search ..... 84/377, 378

(56) References Cited

U.S. PATENT DOCUMENTS

| | | | | |
|---|---|---|---|---|
| 2,565,100 A | | 8/1951 | Tate | |
| 2,664,775 A | | 1/1954 | Zielinski | |
| 4,091,704 A | | 5/1978 | Moe | |
| 4,212,219 A | | 7/1980 | Hubbard | |
| 4,397,213 A | | 8/1983 | Hubbard | |
| 4,497,234 A | | 2/1985 | Strnad | |
| 4,545,277 A | | 10/1985 | Strnad | |
| 4,837,836 A | * | 6/1989 | Barcus | 381/118 |
| 4,984,499 A | | 1/1991 | Schille | |

* cited by examiner

*Primary Examiner*—Shih-Yung Hsieh
(74) *Attorney, Agent, or Firm*—Renner, Otto, Boisselle & Sklar, LLP

(57) ABSTRACT

A harmonica (2) has a body (4) with holes (16) in a front edge thereof through which air can be blown or drawn to vibrate reeds (8, 9) mounted to and under box-like cavities (5) in the body and produce sound; covers (15, 15) create chambers from which sounds exits at the rear (arrow A). At least one microphone (20) is mounted in the rear of the body, facing away from the reeds (8, 9) and in the direction in which the sound travels to amplify the sound.

3 Claims, 1 Drawing Sheet

HARMONICAS

FIELD OF THE INVENTION

This invention relates to harmonicas.

BACKGROUND OF THE INVENTION

A harmonica is a musical instrument having a number of reeds over a surface of which air is passed to cause the reeds to vibrate and emit musical sounds or notes.

In most harmonicas, air may be blown over the surface of a reed or sucked over the surface of another closely-adjacent reed to produce sounds of different pitch. Such harmonicas have been well known for many years and have lately been developed to produce music of various styles. The sounds produced may have to be amplified if used in a performance so that the sound may carry from, e.g. a stage area, to an audience.

In one type of amplifying system, a conventional moving-coil dynamic microphone is held in the musician's hand behind the harmonica. This has been found to be very bulky and restrict the free area behind the harmonica, which in turn reduces the effect of the sound expanding out therefrom. Such microphones are also prone to substantial feedback problems, and are well known to amplify other unwanted sounds, such as breath noise.

SUMMARY OF THE INVENTION

Accordingly, the present invention provides a harmonica having an open rear surface from which sound is in use propagated, the harmonica comprising: a main body including a plurality of box-like cavities, a front edge including a plurality of holes, each being in communication with a respective one of the box-like cavities, and a rear edge; at least one reed disposed in each box-like cavity, each reed being fast at one end thereof to the body and free at the other end thereof such that the passage of air along one surface of any reed causes the reed to vibrate and produce a musical sound; and at least one microphone mounted to the rear edge of the body, the at least one microphone including a sensitive face and being mounted such that the sensitive face is oppositely directed to the open rear surface of the harmonica and in the same direction as the direction of sound propagation.

Preferably, the rear edge of the body includes a recess in which the at least one microphone is located.

Preferably, the harmonica comprises a plurality of microphones, each microphone having a frequency range closely related to that of the sound generated by the part of the harmonica on which the same is mounted.

This harmonica is not of bulky construction, allows for ready connection to an amplifying device, and is such as not to pick up extraneous noises.

BRIEF DESCRIPTION OF THE DRAWINGS

The invention is diagrammatically illustrated by way of example with reference to the accompanying drawings, in which.

DETAILED DESCRIPTION

Figure 1:
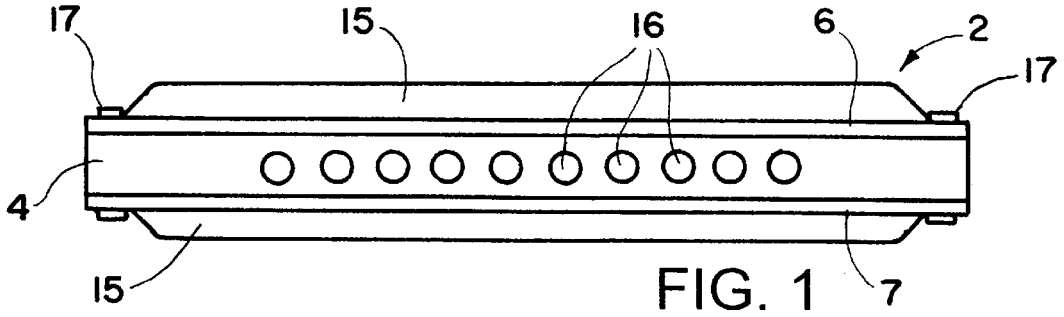
FIG. 1 is a front elevation of a harmonica according to a preferred embodiment of the invention.
Figure 2:
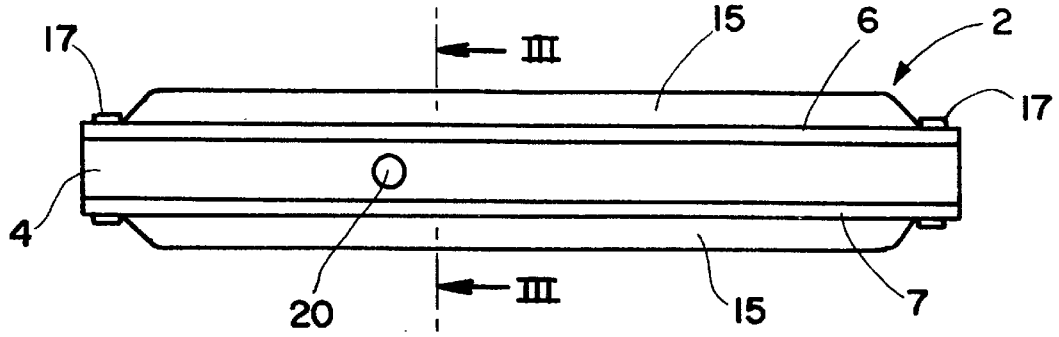
FIG. 2 is a corresponding rear elevation.
Figure 3:
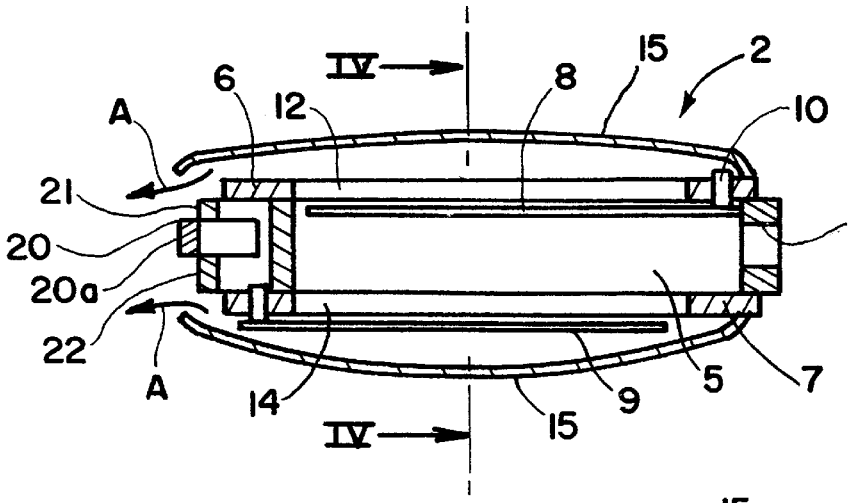
FIG. 3 is a sectional view taken on the line III—III of FIG. 2.
Figure 4:
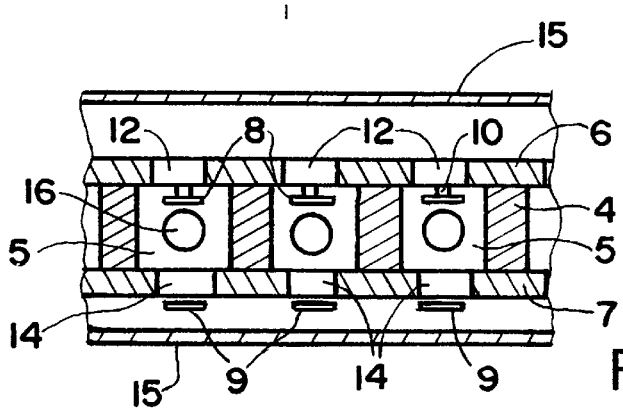
FIG. 4 is a sectional view taken on the line IV—IV of FIG. 3.

The harmonica 2 comprises a main body 4 of moulded thermoplastics material having a plurality of, in this embodiment ten, slots 5 extending therethrough from top to bottom, and upper and lower reed plates 6, 7 disposed on upper and lower surfaces of the main body 4. The slots 5 and the reed plates 6, 7 create box-like cavities.

The harmonica 2 further comprises first reeds 8 secured, in this embodiment each by a respective river 10, to the upper reed plate 6, and further reeds 9 similarly secured to the lower reed plate 7. The first reeds 8 are each located beneath a respective slot 12 formed in the upper reed plate 6, and the further reeds 9 are each located beneath a similar respective slot 14 in the lower reed plate 7.

The harmonica 2 further comprises upper and lower cover plates 15 secured by screws 17, which screws 17 also act to secure the reed plates 6, 7, to the main body 4, and create cavities over the reed plates 6, 7, the cavities being open to the rear of the harmonica 2.

As seen in FIG. 1, the front face of the main body 4 includes a plurality of holes 16, each communicating with a respective one of the slots 5, through which holes 16 an air flow may be induced by blowing or drawing (sucking) air through the vertical slots 5 in the main body 4. As is usual in harmonicas, blown air causes first reeds 8 to vibrate to produce certain musical tones, and drawn or sucked air causes further reeds 9 to produce a different range of tones from that produced by the corresponding first reeds 8. It is well known that the length of each reed 8, 9 determines the pitch or key produced, and different lengths of reeds 8, 9 are provided along the length of the harmonica 2. Thus, as is well known in the art, a pleasing tune can be played by blowing or sucking through different ones of the holes 16 in varying sequences.

Although the direction of the flow of air over the reeds 8, 9 is in opposite directions according to whether it is blown or sucked, the direction of the propagation of the sound is consistently outwardly towards the rear of the harmonica 2 as indicated by the arrows A. Being open backed, the volume and tone of the musical emission can be controlled by enclosing the exit space by suitable manual cupping to a greater or lesser degree.

In present-day harmonica performances, it is not unusual to need to amplify the emitted sound by the use of one or more microphones, and it has hitherto been the practice to hold a microphone in the hand in which the harmonica is cupped. This system leads to difficulties in amplifying the true sound of the instrument and is known to cause feedback noise and the capture and amplification of breath noise.

In order to overcome such difficulties, the harmonica 2 further comprises a miniature microphone 20 secured to the main body 4, in this embodiment mounted in a recess 21 in the rear face 22 of the main body 4, and within the flow route of the sounds. In this embodiment a sensitive face 20*a* of the microphone 20 faces away from the needs 8, 9 and in the direction in which the sound travels.

More than one microphone 20 may be provided, each in a respective recess 21, each microphone 20 having a frequency range which is closely related to that part of the instrument to which it is secured.

The or each microphone 20 may be wired to a socket incorporated within an end portion of the main body 4, either the left-hand end or the right-hand end, or even one at each end, to allow connection to a convenient pre-amplifier within the stage or band electronics gear.

Although the specific embodiment describes and shows reed plates 6, 7 of a standard design, with the reeds 8, 9 riveted over a gap formed in the reed plates 6, 7, a further embodiment (not shown) includes a reed plate and a reed formed from one sheet of metal. A laser cutting technique or other suitable technique, e.g., spark erosion, is used to avoid the use of rivets which are known to introduce stress in the reed which badly effects the tuning of the reed. Tuning is achieved by the removal of precise amounts of metal during machining, resulting in a precision reed of the exact weight and alignment.

What is claimed is:

1. A harmonica (2) having an open rear surface, from which sound is, in use, propagated; the harmonica (2) comprising:

a main body (4) including a plurality of box-like cavities (5), a front edge including a plurality of holes (16), each being in communication with a respective one of the box-like cavities (5) and a rear edge;

at least one of a plurality of reeds (8, 9) being disposed in each box-like cavity (5); each of said plurality of reeds (8, 9) being attached at one end thereof to the body (4) and being free at the other end thereof such that the passage of air along one surface of any of the said plurality of reeds (8, 9) causes that reed (8, 9) to vibrate and produce a musical sound; and at least one microphone (20) mounted to the rear edge of the body (4) the at least one microphone (20) including a sensitive face **(20*a*) and being mounted such that the sensitive face (20*a*) faces away from the plurality of reeds (8, 9) of the harmonica (2)** and in the same direction as the direction of sound propagation.

2. A harmonica according to claim 1, wherein the rear edge of the body (4) includes a recess (21) in which the at least one microphone (20) is located.

3. A harmonica according to claim 1, comprising a plurality of microphones (20), each one of the plurality of microphones (20) having a frequency range closely related to that of the sound generated by the part of the harmonica (2) on which that one microphone is mounted.

* * * * *